United States Patent [19]

Hasenpath et al.

[11] Patent Number: 5,071,257

[45] Date of Patent: Dec. 10, 1991

[54] METHOD OF AND ARRANGEMENT FOR MIXING

[75] Inventors: Jochen Hasenpath, Bad Oldesloe; Thomas Van Hamme, Henstedt-Ulzburg, both of Fed. Rep. of Germany

[73] Assignee: Bran & Luebbe GmbH, Norderstedt, Fed. Rep. of Germany

[21] Appl. No.: 529,904

[22] Filed: May 29, 1990

[30] Foreign Application Priority Data

Apr. 20, 1990 [EP] European Pat. Off. ..... 90107519.2

[51] Int. Cl.[5] ..... B01F 7/26; B01F 5/04

[52] U.S. Cl. ..... 366/169; 366/315

[58] Field of Search ..... 366/150, 154, 155, 160, 366/162, 165, 167, 168, 169, 173, 176, 315

[56] References Cited

U.S. PATENT DOCUMENTS

| | | | |
|---|---|---|---|
| 4,329,066 | 5/1982 | Ivarson | 366/155 |
| 4,671,665 | 6/1987 | McIntire | 366/165 |
| 4,808,004 | 2/1989 | McIntire et al. | 366/155 |
| 4,834,545 | 5/1989 | Inoue et al. | 366/155 |
| 4,884,893 | 12/1989 | Zeiffer et al. | 366/168 |

*Primary Examiner*—Robert W. Jenkins
*Assistant Examiner*—Reginald L. Alexander
*Attorney, Agent, or Firm*—Michael J. Striker

[57] ABSTRACT

Mixing of materials including a first component with a lower pressure and a second component with a higher pressure is performed by introducing the first component with the lower pressure into the second component with the higher pressure, and accelerating the second component by rotation to compensate the pressure difference between the second component and the first component.

22 Claims, 1 Drawing Sheet

METHOD OF AND ARRANGEMENT FOR MIXING

BACKGROUND OF THE INVENTION

The present invention relates to a method of mixing of materials, as well as to an arrangement for mixing. More particularly, it relates to such a method of and arrangement for mixing of materials, in accordance with which a first component especially a particulate material with a low pressure is introduced in a second component especially a fluid under a higher pressure in a dosed manner.

Commercial products frequently include a mixture of various initial components. When these initial components are in the same aggregate state and have similar pressures, the mixing of them pauses no problems. When, however, they have different aggregate states and moreover, are at different pressures during the manufacturing process, such components are frequently mixed in charges. The exact mixing ratios are produced in most instances by weighing the individual components. For compensating the pressure difference it is known either to release one component at a high pressure to the outside pressure or to release the pressure a mixing container and then to introduce for example a particulate material. After this the mixture is again brought to a high pressure which is required for the further process steps.

The known mixing by charges interrupts the available continuous manufacturing processes of the individual components in a disadvantages manner. Moreover, the unloading of a fluid to a lower pressure and the subsequent pressure increase for further processing involves energy losses and as a result high operational costs. For products which include easily volatile components, a pressure reduction frequently leads to quality losses. The mixing by charges in pressure containers leads to increased investment costs.

For continuous addition of particulate materials it is known to use the suction effect of a centrifugal pump, for example for drawing powder from a bin. The bin outlet opens above the center of a vaned rotor in a centrifugal pump. Fluid is supplied concentrically to it. Powder and fluid are thereby simultaneously aspirated and withdrawn from the housing at higher pressure. The disadvantage of this arrangement is the unavoidable use of air. Produced foam must be hindered or destroyed by additional features. The dosing accuracy is low. For orderly operation a minimum conveying quantity is required, that relatively limits the band width of obtainable mixing ratios.

SUMMARY OF THE INVENTION

Accordingly, it is an object of the present invention to provide a method of and arrangement for mixing, which avoids the disadvantages of the prior art.

More particularly, it is an object of the present invention to provide a method of and an arrangement for mixing, in which one component with a lower pressure can be mixed to another component at a higher pressure. In particular, a dosed admixing of particulate materials to a fluid component in a continuous process is possible.

In keeping with these objects and with others which will become apparent hereinafter, one feature of the present invention resides, briefly stated, in a method of mixing in accordance with which the second component supplied at the higher pressure is subjected to such an acceleration by rotation that the pressure difference between the second component and the first component are substantially compensated.

Due to the centrifugal acceleration produced during rotation, the pressure in the center is reduced so that another component, for example pulverized particulate material, can be added in a dosed manner without problems.

In a surprising and unexpected manner it has been found during adding of particulate material to a fluid that the maximum undesirable dragging of air is negligibly low. The movement energy produced during the rotation can be recovered advantageously in a diffuser so as to increase pressure. As a result, the process requires less energy. The rotation can be also produced by suitable guidance of the component which flows in under pressure.

In accordance with another feature of the present invention, an arrangement for mixing is proposed to achieve the above specified objects, which has a housing in which a supply conduit for a second component opens, an admixing conduit for a first component, a discharge conduit for a mixing product, means for imparting acceleration to the second component so as to compensate a pressure difference between the second component and the first component.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE of the drawings is a view schematically showing an arrangement for mixing in accordance with the present invention, in which the inventive method of mixing is used.

DESCRIPTION OF THE PREFERRED EMBODIMENTS

Figure 1:
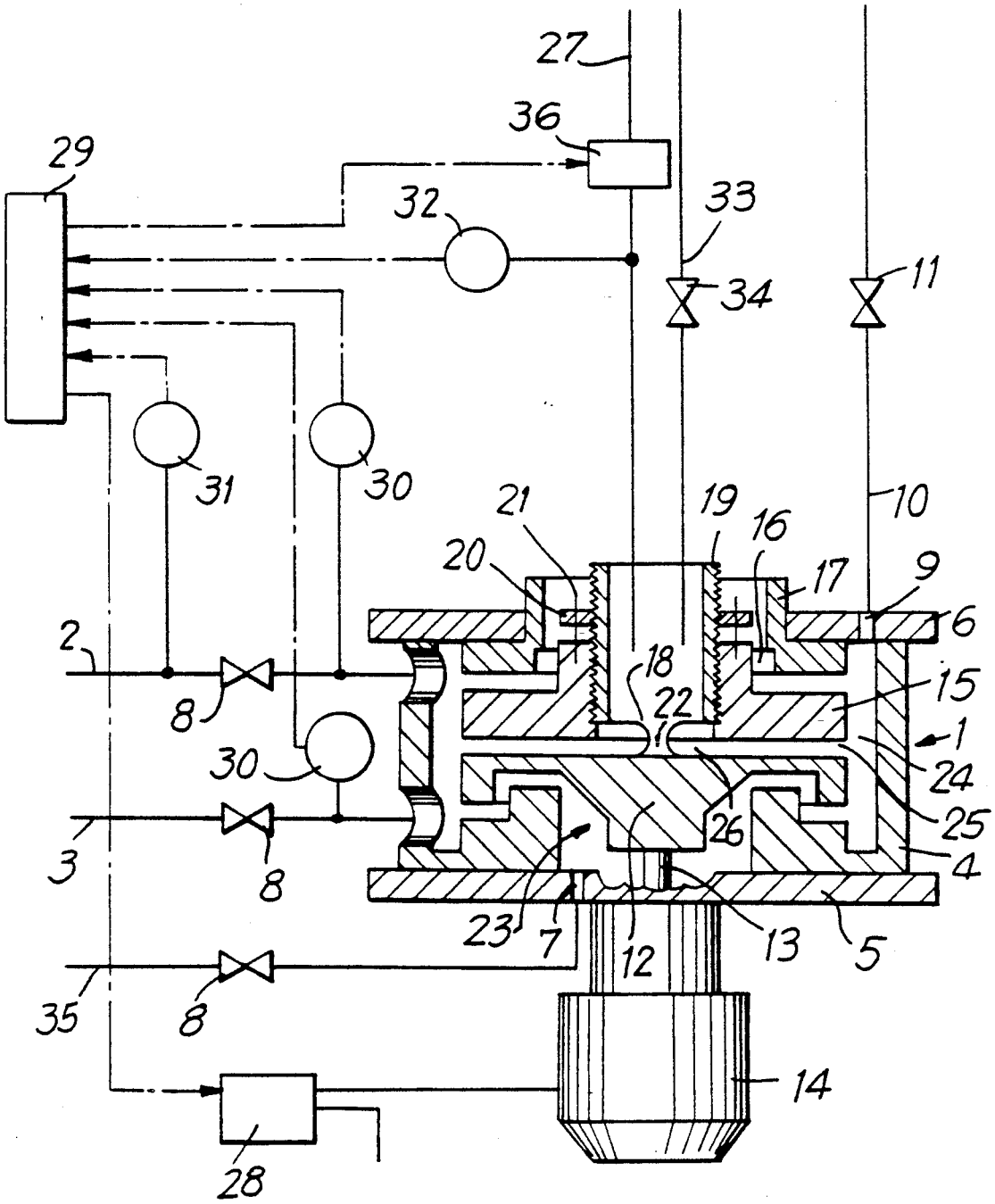

The present invention is illustrated in the drawings and deals with mixing of materials including a first component, such as for example a particulate material at a low pressure being introduced in a second component, such as for example a fluid, at a higher pressure in a dosed manner.

In accordance with the present invention, the second component subjected to the higher pressure is subjected to such an acceleration by rotation that the pressure difference between the second component and the first component is substantially compensated.

At least one rotatable body, for example a plate-shaped body can be used for this purpose. It compensates successive pressure losses.

In accordance with another feature of the present invention, the rotatable bodies can have different angular speeds for supporting the introduction of a solid material into a fluid component. For the same purpose the first component can be admixed on one or several rotatable bodies. The second component can be supplied tangentially to rotation, especially in direction of rotation. This contributes to energy saving during mixing. Especially favorable apparatus solutions for performing the method can be achieved when at least one component is supplied parallel to the axis of rotation.

Dosing problems can be solved in an efficient and simple manner in continuous processes when the distance between the rotatable body and a second rotatable body or a housing is controllable in dependence on at least one component stream and/or in dependence upon the pressure difference.

The operational safety of the process can be increased when a control of the rotation is performed in dependence upon the pressure difference. Also, during pressure fluctuations the second component does not flow into the supply conduit for the first component.

In an inventive arrangement for performing the inventive method with a first component such as particulate material at a higher pressure introducable into a second component such as a fluid, a housing is provided, a supply conduit for the second component and a mixing conduit for the first component and a withdrawal conduit for a mixed product open into the housing, and at least one rotor is arranged in the housing and preferably formed as a plate-shaped rotor.

The rotor runs with an angular speed which approximately corresponds to the rotation of the second component. It contributes to the admixing and distribution of the first component to be admixed. Also, several rotors can be arranged and designed plate-shaped to form a number of rotatable circular gap openings through the first component to be admixed is introduced into the second component.

Excessive pressure losses in the second component can be avoided in that at least one rotor is driven. An energy loss of the arrangement can be avoided when the supply conduit for the second component has an axis which extends tangentially to the housing, especially in the rotation direction of the rotor.

The supply of first component to be admixed can be performed structurally in an especially favorable manner when the admixing conduit of the first component has an axis extending parallel to the direction of the rotary axis of the rotor.

The arrangement can be adjusted to changing operational conditions in continuous processes in an especially simple and reliable manner, when the distance between the rotor and the housing and/or several rotors and/or a rotary speed of at least one rotor are controlled.

A rotation-symmetrical housing of the mixing arrangement is identified with reference numeral 1. A supply conduit 2 opens laterally into the housing, while a withdrawal conduit 3 leads from the housing. The housing 1 has a cylindrical central part 4 which is enclosed from below by a foot plate 5 and from above by a head plate 6. The relief opening 7 is located in the foot plate 5 and connected with a release conduit provided with a valve 8. A ventilating opening 9 with a ventilating conduit 10 and a ventilating valve 11 is provided in the head plate 6 for ventilating the housing 1.

A plate-shaped rotor 12 is arranged rotatably in the housing 1. It is rotatably supported in the foot plate in a not shown manner and fixedly connected with the rotor of a motor 14 by a shaft 13. A second rotor 15 is located opposite to the first rotor 12. It is sealed by a seal 16 relative to the pipe 17. The pipe 17 is fixedly connected with the head plate 6.

The rotor 15 has a central opening 18 provided with an inner thread. The second rotor 15 is screwed by the inner thread on a tubular member 19 which has a respective outer thread. A clamping plate 20 is arranged on the thread of the tubular member 19 by means of a corresponding inner thread. The clamping plate 20 has a plurality of circularly distributed openings for clamping screws 21. Their axes are shown in dash-dot lines. The screws engage in respective threaded openings of the second rotor 15. The rotor 15 is fixedly clamped on the tubular member 19 in a force transmitting manner after tightening of the clamping screws.

A connecting web 22 is provided between the pipes 17 and the lower rotor 12. It connects the lower rotor 12, the tubular member 19, the second rotor 15 and the clamping plate 20 to form a jointly rotatable structural unit 23.

A ring-shaped chamber 24 is formed between the central part 4 of the housing 1 and the rotatable structural unit 23. It communicates with the interior of the tubular member 19 through a gap 25 formed by both rotors 12 and 15 and openings 26 which remain between the web 22. An admixing conduit 27 opens into the tubular member 19.

Both conduits are open perpendicularly into the cylindrical central part 4. However, they can also be connected with the housing 1 tangentially to the latter, in an advantageous manner. When as shown in this example the rotors are driven, the tangential arrangement of the supply contributes to the suction effect of the rotors due to the entraining effect while the tangential arrangement of the withdrawal contributes to the downstream pressure build-up.

A frequency converter 28 is provided for the energy supply the rotor. Through a regulator 29 it provides for regulation of the rotary speed of the motor. The measuring signals of a pressure transmitter 30 in the supply conduit and withdrawal conduit and the signal of a flow meter 31 of the supply conduit 2 serve as input values of the regulator. Together with a volume meter 32 in the admixing conduit 27, both components can be maintained constant after introduction of a corresponding nominal value of the mixing ratio. More particularly it is achieved in that the regulator 29 correspondingly influences a dosing member 36 of the admixing conduit 27. The rotary speed of the motor is regulated preferably independence upon the pressure difference between the pressure in the interior of the tubular member 19 and supply or withdrawl conduits 2, 3. Thereby, a limiting liquid layer formed between the rotor 15 and the rotor 12 is maintained constant in its position.

When a corresponding adjusting member is provided instead of the clamping plate 20 with the clamping screws 21, it is possible to regulate the width of the gap 25 by turning the rotor 15 on the tubular member 19.

In accordance with another embodiment of the invention, the connecting web 22 can be dispensed with. The second rotor can be entrained in rotation by a liquid film formed on the first rotor 12. On the other hand, the second rotor 15 can be provided with its own drive.

For admixing a particulate material, a dosed stream of a first component is supplied to the tubular member 19 for example by a screw conveyor or a controlled vibrating trough. The second component flows through the supply conduit 2 into the ring chamber 24 and due to its viscosity is partially entrained by the rotatable unit 23. Due to the pressure drop between the supply conduit 2 and the admixture conduit 27, the second component flows through the gap 25 in direction to the mixing conduit 27. In a gap 25 it is however subjected to such a rotation that the resulting centrifugal force compensates the pressure difference and a definite limiting surface is formed in the gap 25, so that the first component can be dosed through this limiting surface. The grains of the particulate material fall on the surface of the rotor 12 as a result of this. When they strike, they are partially carried along and taken outwardly through the gap 25 and the formed limiting layer of liquid into the ring chamber 24. There it is engaged by the stream of the second component and leave the housing 1 through the discharge conduit 3.

With the above described arrangement it is possible, with a rotor 12 having a diameter of 220 mm and a rotary speeds 2800 revolutions per minute, to dose particulate material from atmosphere into a watery fluid of a conduit system which has more than 2 bar.

It will be understood that each of the elements described above, or two or more together, may also find a useful application in other types of constructions differing from the types described above.

While the invention has been illustrated and described as embodied in a method of and an arrangement for mixing, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of mixing of materials including a first component with a lower pressure and a second component with a higher pressure, comprising the steps of dosing a first component with a lower pressure into a second component with a higher pressure; and subjecting the second component with a higher pressure to an acceleration by rotation by means of rotation of a plate-shaped rotor having a planar surface throughout its entirety so that a pressure difference between said second component and said first component is substantially compensated.

2. A method as defined in claim 1, wherein said first component is a particulate material, while said second component is a liquid.

3. A method as defined in claim 1, wherein said acceleration by rotation includes rotation of another rotor, the rotors having different angular speeds.

4. A method as defined in claim 1; and further comprising the step of supplying said second component tangentially to the direction of said rotation.

5. A method as defined in claim 4, wherein said supplying includes supplying said second component in a direction of said rotation.

6. A method as defined in claim 1; and further comprising the step of supplying at least one of said components parallel to an axis of said rotation.

7. A method as defined in claim 1, wherein said accelerating includes a rotation by a plurality of such rotors; and further comprising the step of regulating the distance between said rotors in dependence upon a stream of at least one of said components.

8. A method as defined in claim 1, wherein said accelerating includes a rotation by a plurality of such rotors; and further comprising the step of regulating the distance between said rotors in dependence upon the pressure difference.

9. A method as defined in claim 1; and further comprising the step of controlling a distance from said rotor to a housing in dependence upon a stream of at least one of said components.

10. A method as defined in claim 1; and further comprising the step of controlling a distance from said rotor to a housing in dependence upon the pressure difference.

11. A method as defined in claim 1; and further comprising the step of regulating said rotation in depencece upon the pressure difference.

12. A method as defined in claim 1; and further comprising the step of withdrawing a mixed product tangentially.

13. An arrangement for mixing materials including a first component with a lower pressure and a second component with a higher pressure, comprising a housing; a supply conduit opening in said housing for supplying a second component; an admixing conduit opening in said housing for supplying a first component; a withdrawal conduit for withdrawing a mixed product; and means for imparting to the second component such an acceleration by rotation that a pressure difference between the second component and the first component is substantially compensated, said means including a plate-shaped rotor rotatable in said housing and having a planar surface throughout its entirety.

14. An arrangement as defined in claim 13, wherein said means includes a rotor rotatable in said housing.

15. An arrangement as defined in claim 13, wherein said rotor is driven in rotation; and further comprising means for driving said rotor in rotation.

16. An arrangement as defined in claim 13, wherein said supply conduit for the second component has an axis extending tangentially to said housing.

17. An arrangement as defined in claim 16, wherein said supply conduit for the second component has an axis extending in the direction of rotation of said rotor.

18. An arrangement as defined in claim 13, wherein at least one of said conduits has an axis extending parallel to the direction of an axis of rotation of said rotor.

19. An arrangement as defined in claim 13, wherein both said conduits have an axis which extends parallel to the direction of an axis of rotation of said rotor.

20. An arrangement as defined in claim 13, wherein a distance from said rotor to said housing is regulatable; and further comprising means for regulating said distance between said rotor and said housing.

21. An arrangement as defined in claim 13, wherein said means include a second rotor arranged rotatably in said housing, a distance between said rotors being regulatable; and means regulating the distance between said rotors.

22. An arrangement as defined in claim 13, wherein the rotary speed of said rotor is regulatable; and further comprising means for regulating a rotary speed of said rotor.

* * * * *